United States Patent [19]

Gooding

[11] 4,398,306

[45] Aug. 16, 1983

[54] CHIN STRAP SAFETY ATTACHMENT FOR PROTECTIVE HEADGEAR

[75] Inventor: Elwyn R. Gooding, Ann Arbor, Mich.

[73] Assignee: The Regents of the University of Michigan, Ann Arbor, Mich.

[21] Appl. No.: 267,304

[22] Filed: May 28, 1981

[51] Int. Cl.[3] ..... A42B 7/00

[52] U.S. Cl. ..... 2/421; 24/265 R

[58] Field of Search ..... 2/421, 411, 412, 413, 2/414, 423, 10; 24/230 TC, 265 R

[56] References Cited

U.S. PATENT DOCUMENTS

| | | | |
|---|---|---|---|
| 3,239,842 | 3/1966 | Marchello | 2/423 X |
| 3,994,022 | 11/1976 | Villari et al. | 2/413 |
| 4,110,847 | 9/1978 | Dera | 2/421 |

FOREIGN PATENT DOCUMENTS

| | | | |
|---|---|---|---|
| 2812069 | 10/1979 | Fed. Rep. of Germany | 2/421 |
| 1237727 | 6/1971 | United Kingdom | 24/230 TC |

*Primary Examiner*—Peter P. Nerbun

*Attorney, Agent, or Firm*—Stephenson and Boller

[57] ABSTRACT

A chin strap safety attachment including a high impact resistant rigid anchor insert mounted upon a chin strap of the protective headgear. The anchor insert has a tongue which is shaped so as to be insertable into an opening in a coacting anchor plate when the anchor insert is rotated from its normal locking position in engagement with the anchor plate. A Lift-the-Dot fastener, adjustably mounted on the free end of the chin strap adjacent the anchor insert, engages the anchor plate to provide additional securance of the chin strap.

3 Claims, 5 Drawing Figures

CHIN STRAP SAFETY ATTACHMENT FOR PROTECTIVE HEADGEAR

BACKGROUND OF THE INVENTION

1. Field of the Invention

The present invention relates generally to a device to be used in conjunction with a chin strap for securing protective headgear, such as a motorcyclist's helmet or a policeman's helmet, to a wearer's head.

2. Description of the Prior Art

Heretofore, two types of chin strap attaching means have been commonly used to secure a protective helmet to a wearer's head. Each of these prior art attaching means has substantial shortcomings, as described below.

When secured by the first of these two attaching means, a sharp impact to the wearer's head, such as that which occurs when a motorcyclist's head strikes a highway pavement, may cause the chin strap attaching means to become disengaged and allow the helmet to come off, leaving the wearer's head unprotected. Such a chin strap attaching means is disclosed in U.S. Pat. No. 3,944,021 issued Nov. 30, 1976, to Villari et al, which discloses a chin strap looped through a female snap fastener which engages a mating male fastener fixed to the helmet. As the surfaces on the mating parts wear, the spring force of the snap fastener is reduced, and the strap is more easily disengaged from the helmet. The second of the chin strap attaching means commonly used consists of two D-shaped rings through which the chin strap is looped and drawn tightly against the wearer's chin. This type of attachment is very difficult to loosen once it has been tightened properly and is not comfortable to the wearer.

Accordingly, it is an object of the present invention to provide an improved chin strap attaching means which is adapted to be used with protective headgear and which may be made of high impact resistant rigid plastic. It is a further object of the present invention to provide an improved chin strap attaching means that is comfortable and that requires deliberate engagement and disengagement by the wearer in order to positively ensure against unintentional release.

SUMMARY OF THE INVENTION

The chin strap attaching means of the present invention includes various coacting components designed to secure the chin strap against accidental disengagement from the protective helmet.

One component of the chin strap attaching means is an anchor plate which is attached to the helmet. Another component of the chin strap attaching means is an elongated anchor insert which has parallel slots at one end thereof through which the chin strap passes to mount the anchor insert and provide adjustment of the chin strap length. An offset tongue is provided on the other end of the anchor insert and is adapted for insertion in an opening of the anchor plate. The anchor insert and anchor plate interact such that the anchor insert can be disengaged only by rotation of the tongue of the anchor insert through an angle of approximately 90° and thereafter withdrawing the insert from the anchor plate.

A commercial Lift-the-Dot fastener is used in conjunction with the anchor insert to provide additional safety. This commercial fastener is secured to the free end of the chin strap adjacent the anchor insert by an adjustable means such as looping of the chin strap through parallel slots. This commercial snap fastener secures the free end of the chin strap to ensure that the anchor insert is not inadvertently rotated and also permits additional tension to be placed on the chin strap without allowing slippage of the chin strap.

As a result of the present invention, a wearer of a protective helmet can experience improved comfort while being provided with additional assurance against unintentional release of the chin strap. Further objects, features, and advantages of the present invention will become apparent from a consideration of the following description, the above claims, and the accompany drawings.

DESCRIPTION OF THE PREFERRED EMBODIMENT

Figure 1:
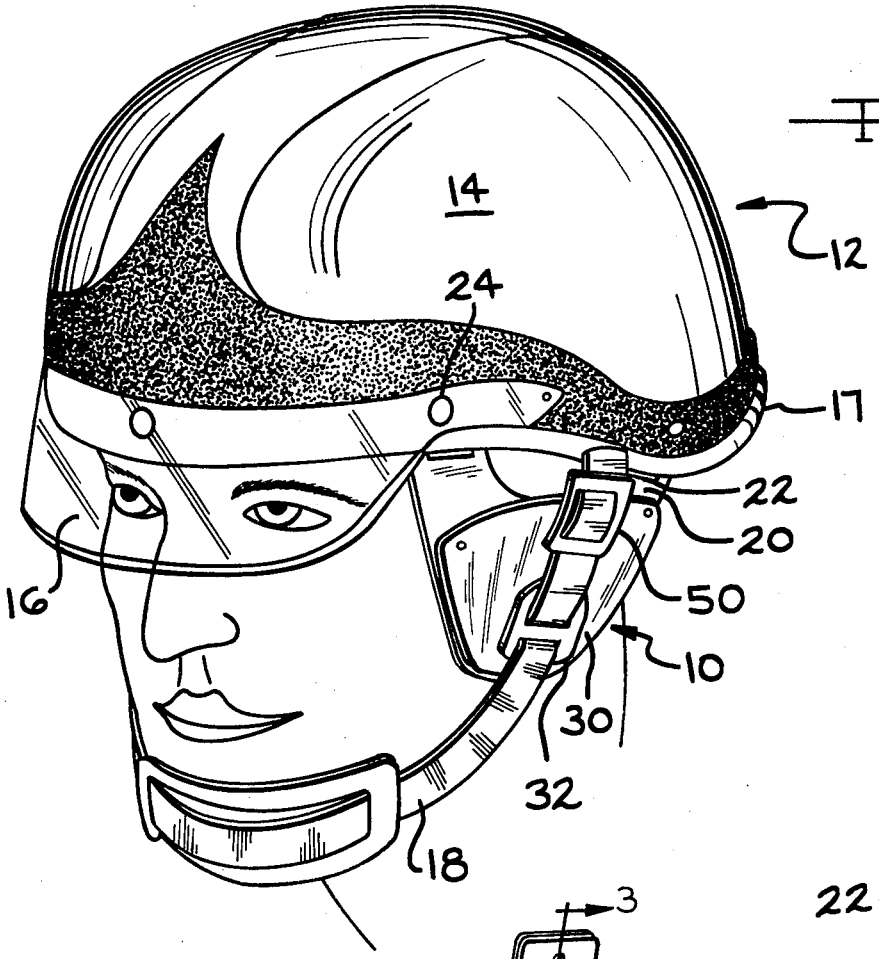
FIG. 1 is a perspective view of the chin strap safety attachment of the present invention as used with a motorcycle policeman's protective helmet.

With reference to the drawing, the chin strap safety attachment of the present invention, indicated generally at 10, is illustrated in FIG. 1 as used in conjunction with a motorcycle policeman's helmet, indicated generally at 12.

Figure 2:
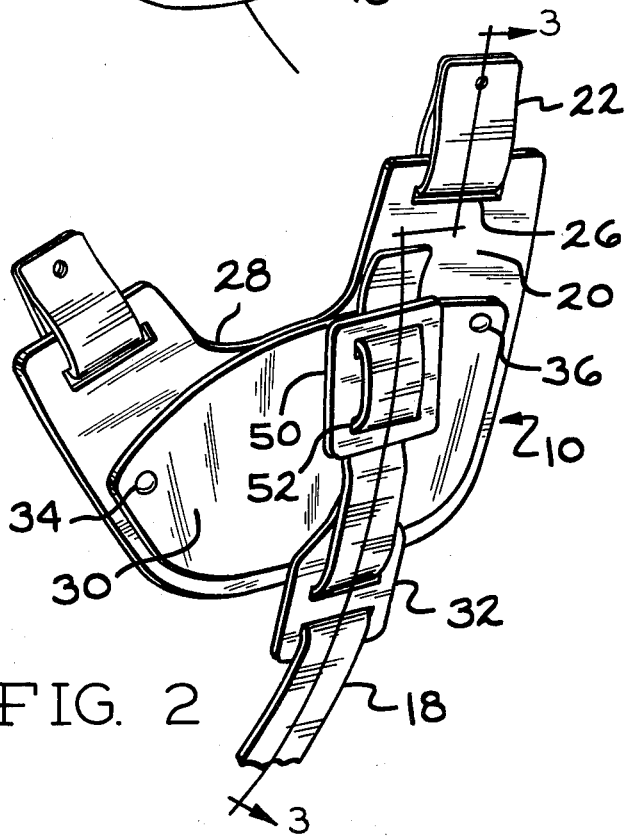
FIG. 2 is a perspective view of the chin strap safety attachment of the present invention mounted upon an ear protective cover of the helmet in FIG. 1.

In the particular application shown, the motorcycle policeman's helmet 12 includes a hard outer shell 14, a visor 16, an edge molding 17, a chin strap 18, and a pair of flexible ear protectors 20. As can be seen in FIGS. 1 and 2, the flexible ear protectors 20 are suspended from web straps 22 secured to the hard outer shell 14 by rivets 24. The web straps 22, usually made of nylon, are looped through slots 26 near the upper edge of the ear protectors 20 at spaced apart locations generally in front of and behind the wearer's ears. The ear protectors 20 may have a crescent shape as shown, having a downwardly scalloped edge portion 28 to provide an opening over the wearer's ear to increase the wearer's comfort and facilitate hearing.

Figure 4:
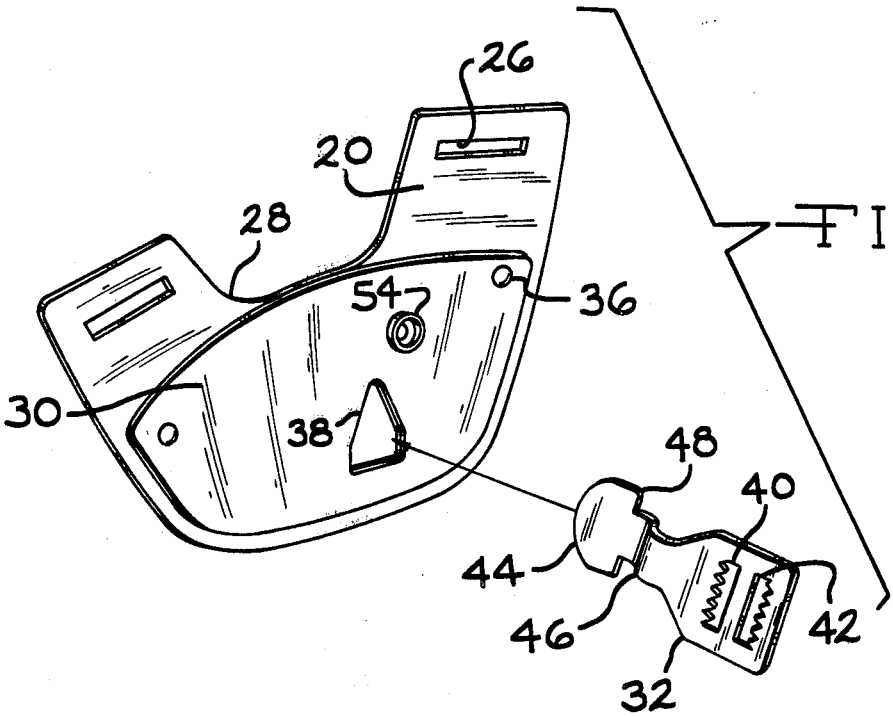
FIG. 4 is a perspective view of the anchor plate of the present invention in relation to the anchor insert as positioned for insertion in the anchor plate.

The chin strap safety attachment 10 includes an anchor plate 30 and a coacting anchor insert 32. Both the anchor plate 30 and anchor insert 32 may be injection molded of high impact resistant plastic or, alternatively, may be stamped from a metal sheet of suitable rigidity. The anchor plate 30 is secured to the lower portion of one of the flexible ear protectors 20 by rivets 34 and 36. As shown in FIG. 4, the anchor plate 30 features a particularly configured opening 38 which coacts with the anchor insert 32 as hereinafter described.

The anchor insert 32, as shown in FIG. 4, is an elongated member having two adjacent transverse slots 40 and 42 at one end thereof for receiving the chin strap 18 which is threaded longitudinally through the anchor insert 32. The slots 40 and 42 may have serrated edges as shown to frictionly secure the anchor insert 32 in a selected position upon the chin strap 18. The other end of the anchor insert 32 forms a rounded tongue 44. An intermediate portion of the anchor insert 32 is reduced in width to form a neck portion 46 and is formed with a bend so as to offset the rounded tongue portion 44 with respect to the sloted portion. The rounded tongue portion 44 terminates in a transversely extending shoulder 48 adjacent to the neck portion 46.

Figure 5:
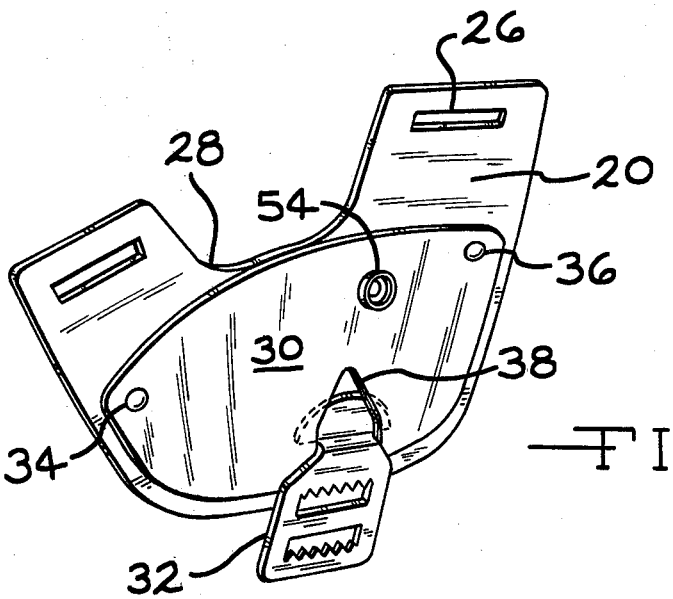
FIG. 5 is a perspective view of the anchor plate and anchor insert of FIG. 4 after the anchor insert has been inserted and rotated by positive engagement with the anchor plate.

The opening 38 of the anchor plate 30 is shaped so as to receive the anchor insert 32 when the anchor insert is aligned as shown in FIG. 4 and to lock the tongue portion 44 of the anchor insert behind the anchor plate when the anchor insert is aligned as shown in FIG. 5. Specifically, the opening 38 is longer in a direction extending longitudinally with respect to the chin strap 18 than in a direction extending transversely thereof. Further, the length of the opening is sufficient to permit the rounded tongue portion 44 to be maneuvered therethrough, and the width of the opening is limited to approximately the width of the neck portion of 46 of the anchor insert. As a result, the shoulder portions 48 of the anchor insert prevent removal of the anchor insert when aligned in the locking position illustrated in FIG. 5. It will be noted that the offset formed in the neck portion 46 permits the anchor insert 32 to lie flat against the anchor plate 30 when the anchor insert is in the locking position.

The chin strap 18 is also secured to the anchor plate 30 by a commercially available Lift-the-Dot snap fastener or a similar spring locking device. The female component 50 of the snap fastener includes two parallel slots 52 for receiving the chin strap 18 which is threaded therethrough. The male component 54 of the fastener is formed as a rivet or grommet and is secured to the anchor plate 30 by peening or spreading or by insertion of a mating element. The location of the male component 54 upon the anchor plate is such that the free end of the chin strap 18 overlies the male component 54 when the chin strap 18 is tightened to its normal wearing position.

Figure 3:
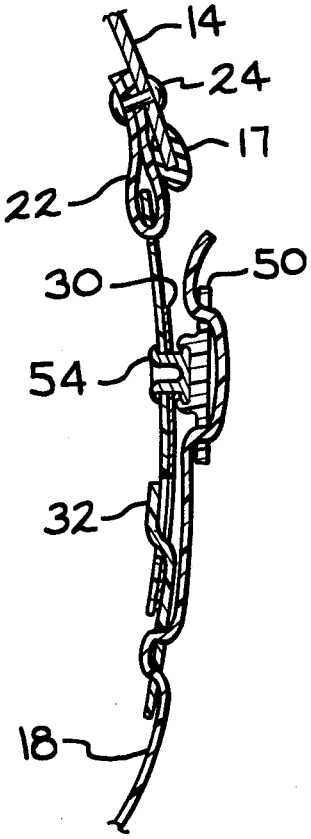
FIG. 3 is a cross-sectional view of the chin strap safety attachment and the ear protective cover of FIG. 2 taken along the line 3—3.

In the operation of the chin strap safety attachment, the helmet is positioned properly on the wearer's head and the chin strap 18 is looped through the anchor insert 32 and is then looped through the Lift-the-Dot female component 50 as shown in FIGS. 1–3. The chin strap is adjusted so that the rounded tongue portion 44 of the anchor insert 32 can be readily inserted through the mating opening 38 of the anchor plate 30. The female component 50 of the snap fastener is adjusted on the chin strap 18 so as to place sufficient tension on the chin strap 18 to lift the anchor insert 32 upward slightly to a position in which the shoulder portions 48 of the anchor insert 32 are just above the lower edge of the opening 38.

From the above description of the preferred embodiment, it can be seen that the present invention provides an improved form of chin strap safety attaching means which is comfortable and yet not susceptible to inadvertent disengagement. The proper adjustment of the chin strap safety attachment will result in a snug, confortable securement of the helmet to the head of the wearer and will permit easy removal of the helmet when the Lift-the-Dot fastener is released and the anchor insert 32 is rotated and withdrawn from the anchor plate 30.

While the preferred embodiment has been described in considerable detail, the present invention is not to be limited to such detail except as may be necessitated by the appended claims.

What is claimed is:

1. A safety attachment for securing protective headgear to a wearer's head comprising:

a chin strap mountable to one side of the protective headgear, extending therefrom so as to engage the wearer's chin and terminate at a free end, an anchor plate having an opening therein and mountable to the other side of the protective headgear in alignment with said free end of the chin strap, anchor insert means mounted on said chin strap at a position adjacent to and spaced from said free end of the chin strap, said insert means being insertable in said anchor plate opening, engagement means on said anchor insert engageable with said anchor plate on opposite sides of said opening when tension is placed upon said chin strap and said anchor insert so as to prevent unintentional removal of the protective headgear, and snap fastener means on said free end of the chin strap engageable with said anchor plate so as to further secure the chin strap when tension is placed thereon and to maintain proper alignment of said anchor insert relative to said opening.

2. A safety attachment for securing protective headgear to a wearer's head as recited in claim 1 wherein said opening in said anchor plate is elongated in a direction longitudinally of said chin strap in a position of said anchor insert means in said opening, and wherein said anchor insert means is insertable in and withdrawable from said elongated opening by rotation of said anchor insert through an angular displacement with respect to the position in which said engagement means is engageable with said anchor plate.

3. A safety attachment for securing protective headgear to a wearer's head as recited in claim 1 wherein said anchor insert means and said snap fastener means are selectively adjustable longitudinally along said chin strap.

* * * * *